United States Patent [19]

Kajiwara et al.

[11] Patent Number: 4,487,050

[45] Date of Patent: Dec. 11, 1984

[54] ROLLING MILL

[75] Inventors: Tetsuo Kajiwara; Kazuyoshi Hashimoto, both of Hiroshima; Takao Kawanami, Kitakyushu; Koichi Mori, Tokai, all of Japan

[73] Assignees: Mitsubishi Jokogyo Kabushiki Kaisha; Nippon Steel Corporation, both of Tokyo, Japan

[21] Appl. No.: 377,943

[22] Filed: May 13, 1982

[30] Foreign Application Priority Data

May 21, 1981 [JP] Japan ..... 56-75663

[51] Int. Cl.[3] ..... B21B 31/20; B21B 13/14

[52] U.S. Cl. ..... 72/243; 72/242

[58] Field of Search ..... 72/242, 243, 245

[56] References Cited

U.S. PATENT DOCUMENTS

| | | | |
|---|---|---|---|
| 3,076,360 | 8/1958 | Senozimir | 72/242 |
| 3,096,672 | 7/1963 | Jones | 72/242 |
| 3,169,423 | 2/1965 | Sims | 72/242 |
| 3,478,559 | 11/1969 | Polakowski | 72/242 |
| 4,194,382 | 3/1980 | Kajiwara | 72/243 |
| 4,369,646 | 1/1983 | Kajiwara | 72/243 |

*Primary Examiner*—Lowell A. Larson
*Assistant Examiner*—Jorji M. Griffin
*Attorney, Agent, or Firm*—Toren, McGeady and Stanger

[57] ABSTRACT

In a rolling mill in which at least one of paired work rolls for rolling metal strips is formed to have a small diameter and is backed up by a pair of first intermediate rolls which in turn are backed up either directly by a plurality of backup rolls or indirectly by a plurality of backup rolls through second intermediate rolls, the rolling mill of the present invention is characterized in that a bearing case containing bearings is provided to each end of the small diameter work roll and to each end of the pair of first intermediate rolls supporting the small diameter work roll so that these rolls are supported on the bearing cases through bearings, and hydraulic cylinders are provided for applying independent roll bending forces to the work roll bearing cases and the intermediate roll bearing cases.

6 Claims, 3 Drawing Figures

ROLLING MILL

DETAILED DESCRIPTION OF THE INVENTION

Figure 1:
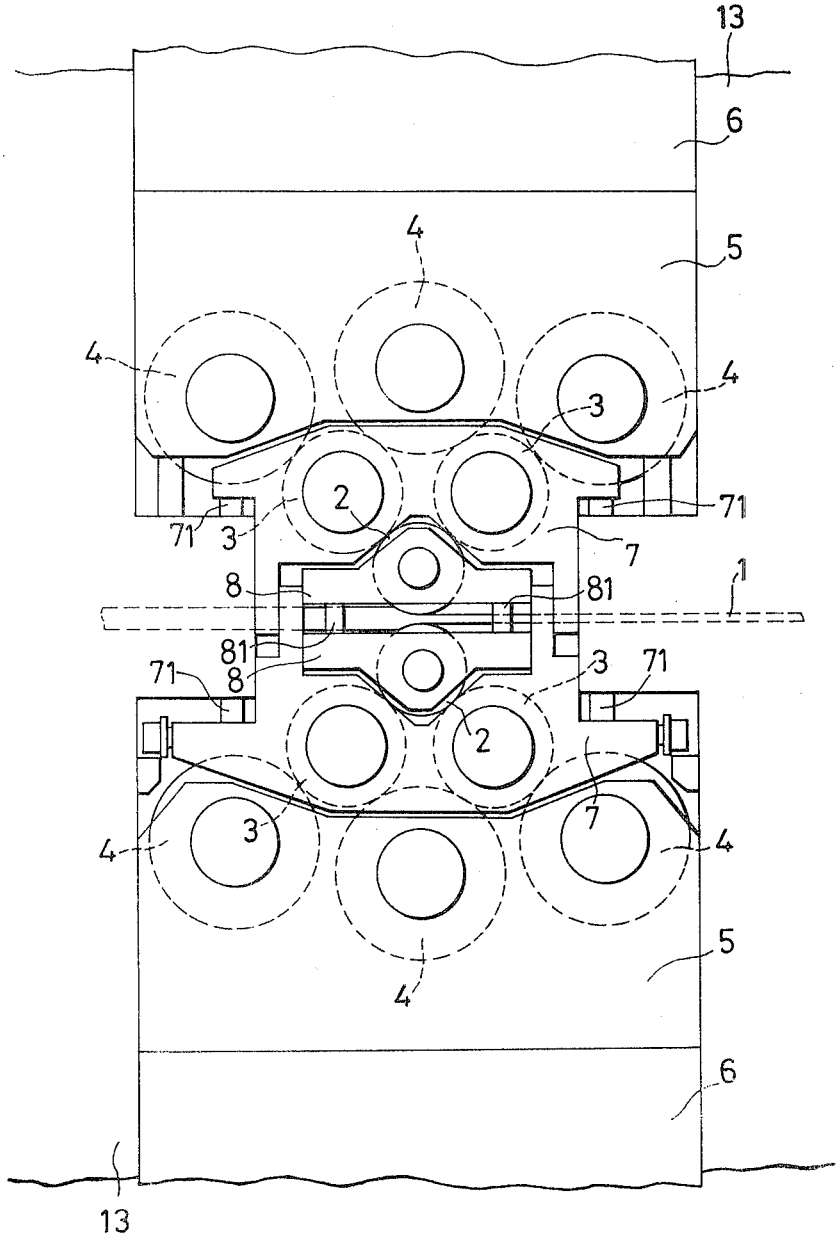

The present invention relates to a rolling mill for rolling metal strips.

In recent years, there is a trend of using higher and higher pressure in rolling metal strips in an effort to improve productivity and save on energy. With high pressure rollings in which a substantial reduction in strip thickness is obtained by a single rolling operation, however, the elastic deformation of the rolls is great due to high rolling load and this results in uneven thickness distribution in lateral direction of rolled strip or irregularities of shape. Because of this sufficiently high rolling pressure cannot be used.

As a technique for solving this problem, a rolling mill as disclosed in the Japanese Patent Publication No. 123/1980 is currently available. In this technique, a pair of intermediate rolls supporting a work roll are displaced along the roll axis in the opposite directions by a distance according to the plate width to reduce the effective support portion of the work roll, i.e., a part of the work roll supported by the intermediate rolls effectively, thereby reducing the bending of the work roll due to the rolling load and improving the work roll bending effect and therefore the shape controllability.

With this method, however, since high rolling load is born by the short support portion of the work roll, not only does the average surface pressure between the work roll and the intermediate rolls become high but the edge portions of the displaced intermediate rolls are applied with a surface pressure 15 times the average surface pressure. This results in abnormal wear or seizing of rolls, leading to shorter rolls life and their frequent replacement causing cost increase.

In cluster mills the known technique for shape control employs split type backup rolls whose axes are moved up and down by eccentric bearings on which they are supported. These backup rolls are bent convex with respect to the work roll so that the intermediate rolls and work roll are deflected by the rolling load along the backup rolls. With this method, however, when the strip to be rolled is narrow in width the rolling load is transmitted almost to the central portion of the rolls, so that the intermediate rolls and work roll will not readily deflect to the curve of the backup rolls. This technique has another disadvantage that the deformation of these rolls resulting from the contact between the rolls is large in the central area and the convex deformations of the backup rolls hardly affect the work roll.

The research for a means to solve these drawbacks has led the inventors of this invention to find that an increase in convex deflection of the backup rolls greatly reduces the load acting upon the edge portions of the intermediate rolls and the work roll and the convex deflection of the backup rolls has no effect on the work roll. To correct this, we also find it most appropriate to apply a roll bending force to the intermediate rolls bending them along the backup rolls and also apply the roll bending force to the work roll bending it along the intermediate rolls.

In more detail, the conventional drawbacks are overcome by the rolling mill of this invention in which at least one of paired work rolls for rolling metal strips is formed to have a small diameter and is supported by a pair of first intermediate rolls; the paired first intermediate rolls in turn are either directly backed up by a plurality of backup rolls or indirectly backed up by a plurality of backup rolls through second intermediate rolls; a bearing case containing bearings is provided to each end of the small diameter work roll and to each end of the pair of first intermediate rolls supporting the small diameter work roll so that these rolls are supported on the bearing cases through bearings; and means are provided for applying independent roll bending forces to the work roll bearing cases and the intermediate roll bearing cases.

An object of this invention is to provide a rolling mill which can perform a high pressure rolling and provide rolled products with little thickness distribution irregularities in lateral direction.

Another object of this invention is to provide a rolling mill which can perform high pressure rolling with little thickness distribution irregularities even when the strip to be rolled is narrow in width.

Still another object of this invention is to provide a rolling mill which has no possibility of causing abnormal wear or galling of the rolls.

The present invention will be explained in conjunction with the preferred embodiments referring to the attached drawings.

Figure 2:
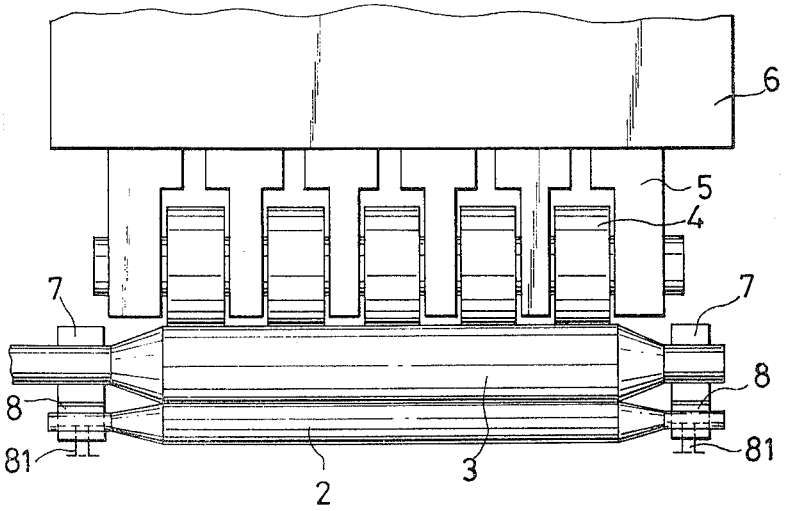
Figure 3:
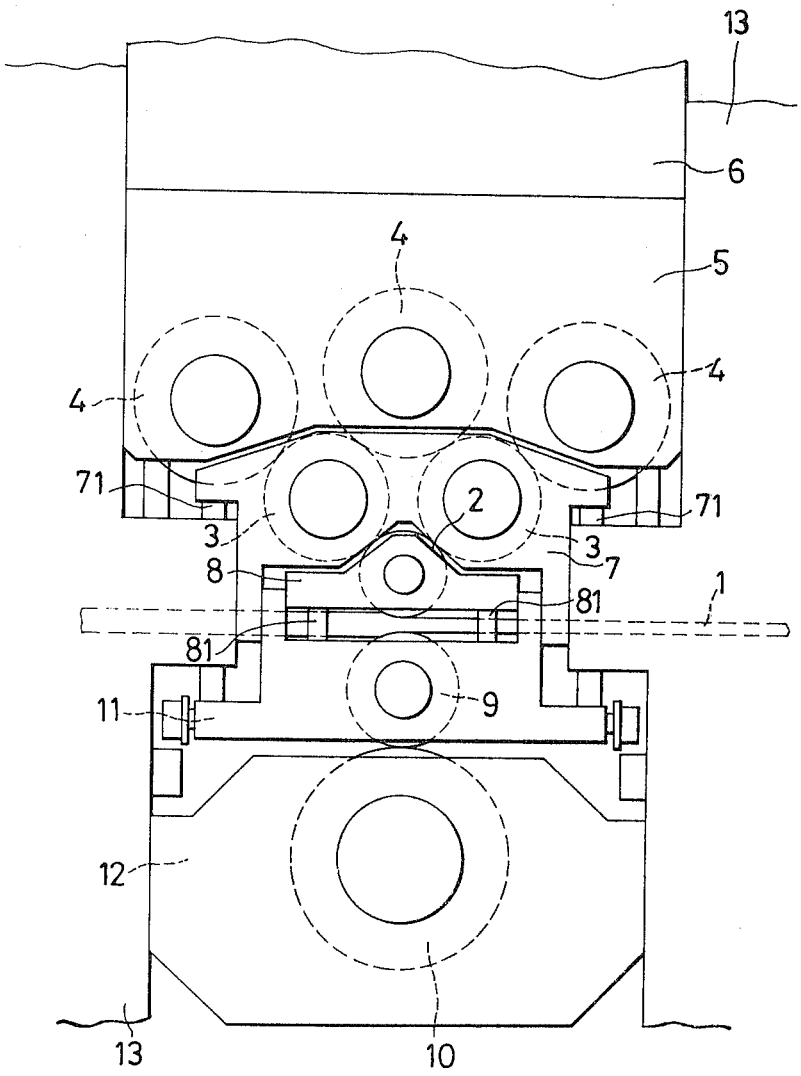

FIGS. 1 and 2 show the first embodiment of this invention, FIG. 1 being a side view of the main portion and FIG. 2 its front view (with the lower half omitted). FIG. 3 is a side view of the second embodiment of this invention showing only the main portion.

In FIGS. 1 and 2, denoted 1 is a metal strip rolled by a pair of work rolls 2 of small diameter. The small diameter work roll is the work roll used in cluster mills in which the work rolls are supported by intermediate rolls and backup rolls, and it has such a small diameter as can be bent more easily than the work roll of a conventional 4-stage rolling mill. 3 represents a pair of first intermediate rolls supporting the small diameter work rolls 2 and 4 indicates backup rolls backing up the intermediate rolls 3 and which are supported on a fixed bearing 5. As can be seen in FIG. 2, the back-up roll 4 is subdivided in the axial direction and each subdivided back-up roll portion is provided with an eccentric bearing. The shaft of the bearings is supported by the frame through the fixed bearing 5. By adjusting the amount of eccentricity with the shaft of the bearings and controlling pressing force on the intermediate roll, it is effected to correct the sagging of the work roll due to rolling load. In obtaining a flat rolled plate, when a metal plate of narrow width, as compared with the effective width of the backup roll, is supplied for entry, the intermediate roll and backup roll become unbending along the backup roll and, therefore, in order that the intermediate roll may bend along the backup roll and then the work roll may bend along the intermediate roll, roll bending means is provided at the intermediate roll and work roll, respectively, thus improving the function of shape control of the metal plate. The fixed bearing 5 is in turn mounted in a support frame 6. At each end of the pair of intermediate rolls 3 are provided bearings (not shown) which are housed in bearing cases 7. At each end of the work rolls 2 are provided bearings (not shown) which are housed in bearing cases 8. Provided between a rolling mill housing 13 and a bearing case 7 of the intermediate rolls 3 is an intermediate roll hydraulic cylinder 71 which imparts a roll bending force to the intermediate rolls 3 through the bearing case 7. A work roll hydraulic cylinder 81 is interposed between two work roll bearing cases 8 to apply a roll bending force to the work rolls 2 through the bearing cases 8.

FIG. 2 is a front view showing the main portion of the first embodiment with the lower half omitted since the upper and lower halves of rolling mill of this invention are symmetrical.

Next, the action and effect of this invention will be described in the following.

The reason for the difficulty in controlling the shape of narrow strips is that the intermediate rolls 3 do not bend along the backup rolls 4 even if the backup rolls 4 are bent convex because the rolling load is born by the central portion of these rolls.

In this invention, to make the intermediate rolls 3 bend sufficiently along the backup rolls 4, intermediate roll hydraulic cylinders 71 are employed to apply a roll bending force to the intermediate roll bearing cases 7 at each end of the intermediate rolls 3. In this case, since the work roll 2 is small in diameter the most part of the work roll 2 bearing against the metal strip 1 is bent by the rolling load along the intermediate rolls 3. However, the amount of deformation in the work roll as caused by the contact with the metal strip greatly decreases toward the edge of the metal strip 1 resulting in what is called an edge drop. The conventional shape correction means that applies the roll bending force to the intermediate rolls is not enough to eliminate the edge drop in the metal strip. To avoid the edge drop, the present invention employs work roll hydraulic cylinders 81 to apply a roll bending force also to the work roll 2.

It is known that when a roll bending force is applied to the small diameter work roll the effect of bending reaches only the edge portion of the metal strip with the central portion almost uneffected. With the present invention, the intermediate roll hydraulic cylinders 71 imparting a roll bending force to the intermediate rolls 3 corrects rough irregularities in the metal strip shape and the work roll hydraulic cylinders 81 applying roll bending force to the work rolls 2 corrects fine shape irregularities near the edge of the metal strip 1. This combined use of the intermediate and work roll hydraulic cylinders 71 and 81 makes it possible to correct the composite shape irregularities of the strip arising from the increase in length at the central and the edge portion.

In cluster mills, when a roll bending force is applied to the pair of first intermediate rolls 3, the work roll 2 of small diameter bent along the intermediate rolls 3 may also deflect in the direction of rolling if the two intermediate rolls 3 do not deform in the same way. Thus, the resulting interference between the work roll 2 and the strip 1 may cause the work roll to vibrate and the strip to wind its way. Where the roll bending force is applied to the individual bearing cases each supporting the end of each intermediate roll 3, it is considerably difficult to maintain the deformations of two intermediate rolls 3 equal.

Hence, with this invention the two bearings provided at each end of the intermediate rolls 3 are held together in one bearing case 7 so that these two bearings are subject to the same force or condition, that is, when the bearing case 7 on each side is applied with a roll bending force by the intermediate roll bending apparatus 71, the roll bending force acting on the intermediate rolls 3 produces the same deformations on the paired rolls. Further, the use of the bearing case 7 of this invention reduces the amount of work required for replacement of intermediate rolls 3 since the paired rolls 3 have to be drawn out and inserted only once.

The shape controllability of the metal strip 1 as obtained by applying the roll bending force to both the intermediate rolls 3 and the small diameter work roll 2 is very satisfactory. This may be accounted for by the small diameter of the work roll. Application of this invention only to the roll trains on one side of the mill provides substantial improvement on the shape controllability. FIG. 3 shows a second embodiment of this invention, in which a large-diameter work roll 9 is backed up by a large-diameter backup roll 10. The work roll is supported by bearing cases 11 and the backup roll by bearing cases 12. Same reference numerals are assigned to parts that are identical to those of the first embodiment and explanation on them will be omitted here.

While in the above two embodiments the housing 13 is used as a base for applying the roll bending force to the first intermediate roll bearing case 7, it is also possible to use other member such as the support frame 6, the large-diameter work roll bearing case 11 or the large-diameter backup roll bearing case 12 as a base from which to apply the roll bending force to the intermediate roll bearing case 7. With this invention, it is arbitrary to select any convenient base for the application of the roll bending force.

For the case where the first intermediate rolls 3 are backed up by second intermediate rolls (not shown) which in turn are backed up by the backup rolls 4, the second intermediate rolls are deflected sufficiently by the first intermediate roll bending force since the cluster roll trains have great body lengths as compared to their diameters. In this case also, a good shape controllability the same as the first and second embodiments can be obtained.

Any type of backup rolls other than the split type backup rolls used in the preceding embodiments can be employed. The means for applying roll bending force to the work roll and the intermediate rolls is not limited to those using hydraulic pressure and other roll bending application means may be used.

The present invention is not limited to the embodiments described above or shown in figures but covers various modifications that can be made by any person skilled in this art.

What is claimed is:

1. In a rolling mill in which at least one of paired work rolls that roll metal strips is formed to have a small diameter as can be bent more easily than the work roll in a conventional 4-stage rolling mill and is backed up by a pair of separate intermediate rolls spaced laterally apart and contacting said small diameter work roll at angularly spaced locations on said work roll which in turn are backed up by a plurality of separate, spaced backup rolls; the improvement comprising: each of said backup rolls is subdivided in the axial direction into spaced backup roll portions, each said backup roll portion is in contact with at least one of said intermediate rolls, a first bearing case containing a bearing is provided to each end of the small diameter work roll and a second bearing case containing bearings is provided to each end of the pair of intermediate rolls supporting the small diameter work roll so that these rolls are supported on the bearing cases through said bearings; and means for applying independent roll bending forces to the work roll bearing cases and to the intermediate roll bearing cases.

2. A rolling mill as defined in claim 1, wherein only one of the paired work rolls is formed to have a small diameter and is backed up by the paired intermediate rolls, and said means are provided for applying independent roll bending forces to the small diameter work roll first bearing cases and the intermediate roll second bearing cases backing up said small diameter work roll.

3. A rolling mill as defined in claim 1, wherein both of the paired work rolls are formed to have a small diameter and each is backed up by a separate said paired intermediate rolls and said means are provided for applying independent roll bending forces to the first bearing cases of one of the small diameter work rolls and to the second bearing cases of the intermediate rolls supporting that small diameter work roll.

4. A rolling mill as defined in claim 1, wherein both of the paired work rolls are formed to have a small diameter and each is backed up by a separate said paired intermediate rolls and said means are provided for applying independent roll bending forces to the first bearing cases of the paired small diameter work rolls and to the second bearing cases of the intermediate rolls supporting the paired small diameter work rolls.

5. A rolling mill as defined in claim 1, wherein the pair of intermediate rolls are directly supported by a plurality of backup rolls wherein at least two said backup rolls contact each said intermediate roll.

6. A rolling mill as defined in claim 1, wherein an eccentric bearing is provided for each of said backup roll portions.

* * * * *